US005381572A

United States Patent [19]

Park

[11] Patent Number: 5,381,572

[45] Date of Patent: Jan. 17, 1995

[54] TWIST ROLLING BED

[76] Inventor: Young-Go Park, Apt. #NA-305 Dong-A Apt.s No. 902 Daechi-Dong Kangnam-Ku, Seoul, Rep. of Korea, 135-280

[21] Appl. No.: 806,214

[22] Filed: Dec. 13, 1991

[30] Foreign Application Priority Data

Jan. 9, 1991 [KR] Rep. of Korea ..... 180/91
Apr. 15, 1991 [KR] Rep. of Korea ..... 5972/1991

[51] Int. Cl.[6] ..... A61G 7/057; A47D 9/02

[52] U.S. Cl. ..... 5/600; 5/109; 601/90; 601/91

[58] Field of Search ..... 5/109, 108, 600; 601/26, 90, 91

[56] References Cited

U.S. PATENT DOCUMENTS 4,227,269 10/1980 Johnston .
4,628,556 12/1986 Blackman ..... 5/424
5,107,555 12/1990 Thrasher ..... 5/108

FOREIGN PATENT DOCUMENTS 59-43179 10/1984 Japan .
59-46179 11/1984 Japan .
60-5292 2/1985 Japan .
60-57327 12/1985 Japan .
61-45852 3/1986 Japan .
62-11457 1/1987 Japan .
62-25385 6/1987 Japan .
62-38970 8/1987 Japan .
63-38862 3/1988 Japan .
63-27713 7/1988 Japan .
63-128848 8/1988 Japan .
64-28152 2/1989 Japan .

*Primary Examiner*—Alexander Grosz
*Attorney, Agent, or Firm*—Robert E. Bushnell

[57] ABSTRACT

A twist rolling bed, adapted for health care for use in a hospital, home, health club, etc, comprises a stationary bed frame longitudinally inclined by an inclining device having a support assembly thereon to roll a mattress support assembly, a saddle assembly providing a center support for the mattress support assembly, and a vibrating system with a motor to reciprocate the mattress support assembly which is has a motor crank assembly, a connecting rod assembly. The mattress support assembly is torsionally flexible and comprises of a plurality of pipes on a plane whose ends are rotatably, pivotally, and slidably inserted into holes on a central line of two rectangular bars. The pipes ride on the saddle assembly, whereas the two rectangular bars are carried by the support assembly. Alternatively, the mattress support assembly described above could be replaced by a rigid assembly.

41 Claims, 6 Drawing Sheets

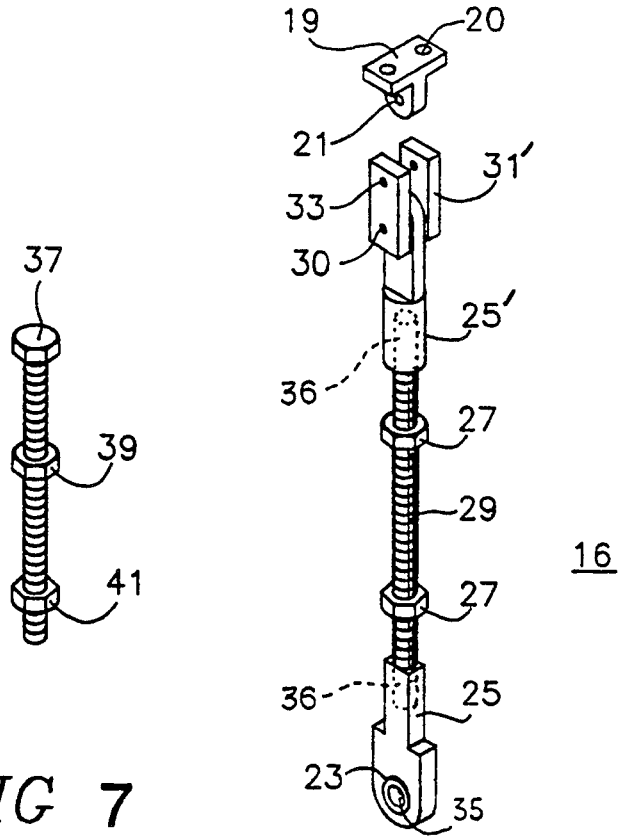
FIG 7
FIG. 6
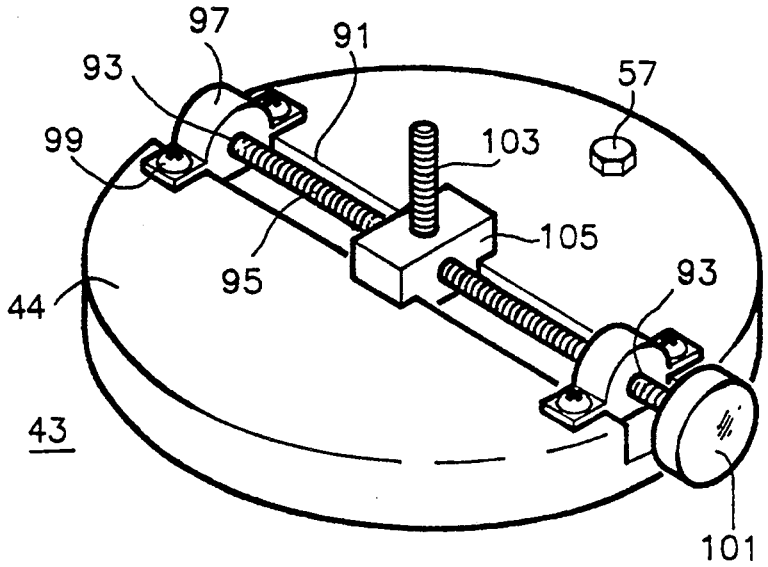
FIG. 8

TWIST ROLLING BED

BACKGROUND OF THE INVENTION

The present invention generally relates to rolling beds, chairs and twist rolling beds, and more particularly, to a twist rolling bed which provides a human body with physical twist and rolling exercises, and also enables the changing of sleeping posture for health care reasons in a room, hospital, or an office room.

Various beds and chairs that provide for the changing of sleeping or sitting positions statically are known. Beds or chairs, however, which provide the human body with dynamic and continuous rolling or twist rolling, or changing of position either during sleep or at other times, are not available.

For instance, the prior art includes Japanese Pat. Nos. 62-38970, 60-5292, and 60-57327; Utility Model Public Open Nos. 64-28152, 63-38862, 63-128848, 61-45852, 61-107350, and 62-11457; and U.S. Pat. Nos. 4,227,269 and 4,628,556 each of which statically change position or posture before sleep, but not during sleep.

My earlier invention, a rolling bed and chair, described in a Patent application filed on Jul. 9, 1990 in the Patent and Trademark Office of the Republic of Korea, has following disadvantages:

Its first disadvantage is that, because a crank arm is made of a single rod, a shearing force between the crank arm and the connecting rod could be hazardous to a baby who might crawl under the bed. Second, it has no energy saving device. Third, a stop position after rolling was not specified. Fourth, its operational time is not specified. Fifth, its amplitude of vibration is not adjustable. Sixth, its longitudinal inclining device is not attached. Finally, it has no capability for a twist rolling operation.

SUMMARY OF THE INVENTION

An object of the present invention, is to provide a human body with forced rolling and massage exercises continuously, periodically and/or arbitrarily, as well as to provide various sleeping postures such as upright or inclined left or right. Another object is to provide the human body with forced twist rolling exercises and other things. These exercises will expedite blood circulation and digestion and thereby facilitate recovery and increase metabolism. This is accomplished by exercising the intestines and muscles, twisting backbones, and sliding bones relative to each other. Further, the blood circulation will be affected in various parts of the human body because of changing pressure caused by gravity since various parts will be released and placed under pressure by the various movements of the present invention. In other words, blood circulation will be expedited because various body parts will be pressurized or released from pressure continuously and periodically, which is preferable to a body condition in which parts are continuously pressured, even if the continuous pressure is less than peak pressure of the changing pressure.

Accordingly, it is the object of the invention is to provide a rolling bed and a rolling chair which can supply continuous periodic and arbitrary rolling exercises or twist rolling exercises to the human body, especially to the intestines for, health care.

A further object of the present invention is to substitute a circular crank plate of the motor crank assembly for the crank arm.

A still further object of the invention is to provide the rolling bed with an energy saving device.

Another object of the invention is to provide beds with the specific stop position at any time during operation.

An additional object of the invention is to provide these beds with longitudinal inclining devices.

An even further object of the present invention is to provide the beds and chairs with an easily adjustable crank arm assembly allowing for adjustment during operation.

A rolling bed, according to an aspect of the present invention, comprises: a mattress support; a bed frame; a support assembly attached to both ends of a central longitudinal axis of the bed frame supporting, longitudinally and rotatably, the mattress support; an inclining device having two bolts with one at each corner of one end of the bed frame, respectively; an energy saving device including springs attached to the four corners of the bed frame by spring housings; and a vibrating system including a connecting rod assembly, a motor crank assembly, and an electric control switch board, attached on a corner of the bed frame, for reciprocating a corner of the mattress support.

A rolling chair is similar to the rolling bed except that a chair is substituted for the mattress support.

A twist rolling bed is similar to a rolling bed except that the mattress support is replaced by a mattress support assembly. A saddle assembly is additionally included at a longitudinally middle part of the bed frame to allow the mattress support assembly to twist rollingly. The mattress support assembly is constructed of rectangular frame support bars which have pivotable shaft bearings in circular holes and a plurality of circular pipes having both ends inserted into the pivotable shaft bearings of the rectangular frame support bar.

BRIEF DESCRIPTION OF THE DRAWINGS

FIG. 6 is a perspective view of a connecting rod assembly embodying the present invention;

FIG. 7 is a perspective view of crank pin bolts and nuts embodying the present invention;

FIG. 8 is an elevational perspective view of an adjustable crank arm assembly embodying the present invention;

DETAILED DESCRIPTION OF THE PREFERRED EMBODIMENT

Figures 1, 2:
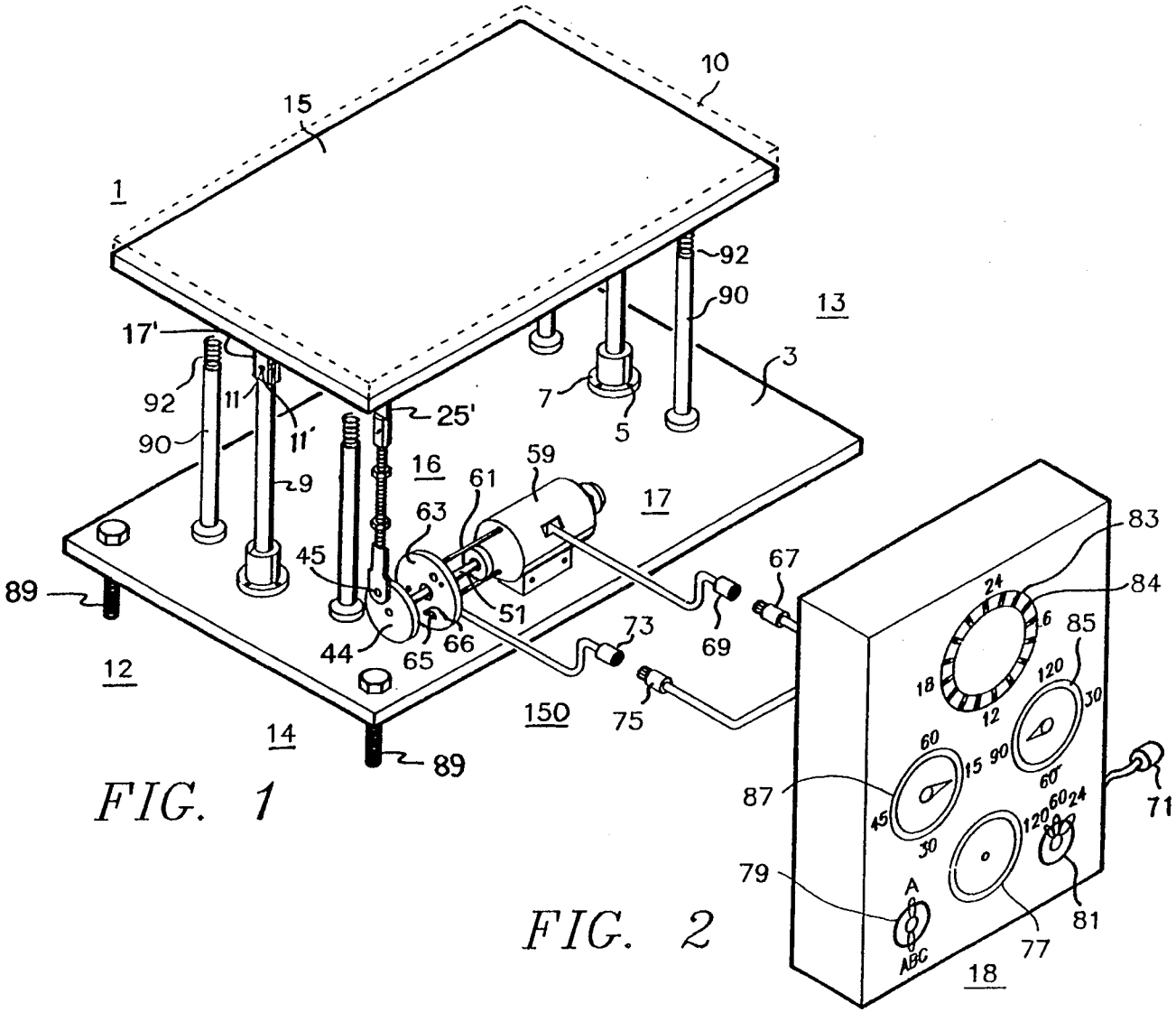
FIG. 1 is a perspective view of a rolling bed embodying the present invention.
FIG. 2 is a perspective view of a electrical control switch board embodying the present invention.

Referring FIG. 1, a rolling bed 1 provides a human body with rolling pleasure, massage, and posture change during sleeping, especially for health care, continuously or periodically or arbitrarily at any time. The rolling bed 1 comprises, a mattress support 15, a bed frame 3, a support assembly 12, a inclining device 14, an energy saving device 13, and a vibrating system 150.

The support assembly 12, see FIGS. 1 through 8, comprises bolts 5, post stands 7, posts 9 inserted into the post stands 7 and having bolt holes 11 with bolts 11' therein, and bearing housings 17' rotatably connected to the post holes 11 by bolts 11' and its bearing holes (not shown). The support assembly is bolted firmly to both ends of a central longitudinal axis of the bed frame 3 and supports, longitudinally and rotatably, the mattress support 15. The mattress support 15 and bed frame 3 can be constructed of rigid plywood or a metal structure. The mattress support 15 supports a mattress 10.

The inclining device 14 is constructed of two bolts 89 bolted to each corner of one end of the bed frame 3.

The energy saving devices 13 are constructed of four coil springs 92 engaging corners of the mattress support 15 and freely inserted into the spring housings 90. The energy saving devices are firmly and perpendicularly attached at the corners of the bed frame 3.

The vibrating system 150 comprises connecting rod assembly 16, motor crank assembly 17, and electrical control switch board 18 of FIG. 2.

The connecting rod assembly 16, see FIGS. 1 and 6, is constructed of a connecting bolt 29 with one end connected to a rod bearing housing 25 having a female thread 36 and locked by a lock nut 27. The connecting rod assembly 16 also comprises a rod bearing 23 and rod bearing hole 35. The connecting bolt 29 is also connected to another rod bearing housing 25' whose bearing hole 35 (not shown) is connected two side plates 31' on both sides by their bolt holes 30 which rotatably connect the connecting rod flange 19 by their holes 33, 21 and a bolt and nut (not shown). Connecting rod flange 19 is finally connected to the under corner of the mattress support 15 by its holes 20 and bolts (not shown).

Figure 3:
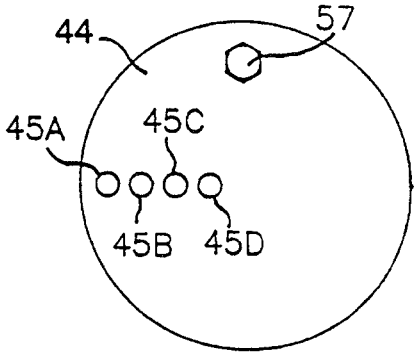
FIG. 3 is an expanded front elevational view of a circular crank plate embodying the present invention.
Figure 4:
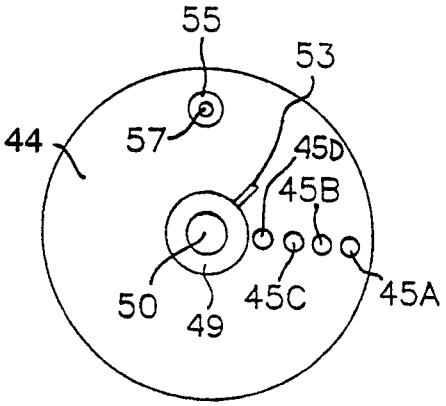
FIG. 4 is an expanded rear elevational view of a circular crank plate embodying the present invention.
Figure 5:
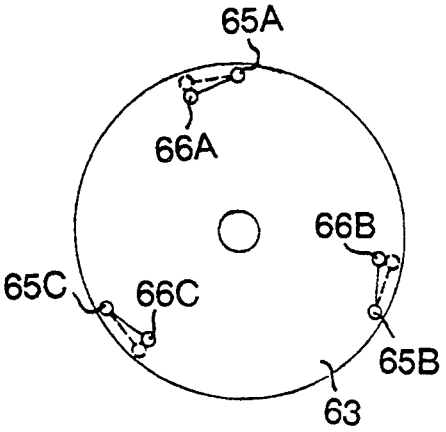
FIG. 5 is an expanded front elevational view of a motor stop circular switch embodying the present invention.

The bearing hole 35, shown in FIG. 6, is connected, by a bolt 37 shown in FIG. 7 and nuts 39, 41, respectively to one of the crank arm pin bolt holes 45A, B, C, or D of the circular crank plate 44 shown in FIGS. 3, 4, and 5, to adjust the radius of the crank arm and to reciprocate the connecting rod assembly 16. The motor crank assembly 17 is constructed by connecting the circular crank plate 44 to the roller cam 55 with fastening bolt 57. A variable speed motor 59 comprises a motor shaft 51 which is connected to crank flange 49 through shaft hole 50 with lock bolt 53.

Referring to FIG. 5, the motor stop circular switch plate 63 has motor stop position switches 65A, 65B and 65C and stop switch cam follower 66A, 66B and 66C mounted thereon. The motor stop circular switch plate 63 has a hole at its center for receiving the motor shaft 51 therethrough and is supported by the stays 61. Signals generated by the cam 55, cam follower 66 and switches 65 are received by the electric control switch board 18 through the signal receiving socket 75 and the signal sending plug 73. The motor 59 is controlled by sending electric power from the switch board 18 through the power source socket 67 and plug 69. The electric power is conveyed to the switch board 18 through a switch board power source plug 71. The switch board 18 comprises mattress support stop position selector switch 79, push-on/push-off switch 77, timer selector switch 81, twenty-four hour timer switch 83, operation timer switch 85, and stop timer switch 87.

The electric control switch board 18 can control the rolling bed 1 with five different operations. The first operation is a manual switch on-off operation. When the push-on/push-off switch 77 in FIG. 2 is "on," the mattress support 15 starts to roll, and and when it is "off" it stops only at the horizontal position of the support 15 in response to signals generated by the motor stop position switch 65 A in FIG. 5 motivated by the stop position cam follower 66A which is pushed out by the roller cam 55 in FIG. 4.

The amplitude of the rolling of the mattress support 15 depends on the selection of the crank arm pin bolt hole 45, and its speed depends on a reduction gear (not shown) connected to the motor 59. The amplitude and speed of the rolling can be selected by the user. A motor brake (not shown) is installed in the motor 59 in order to hold the mattress support 15 horizontal when the motor is stopped.

A second operation employs a horizontal stop and automatic twenty-four hour operation cycling operation. When the push-on push-off switch 77 is "off", the mattress support stop position selector switch 79 is at the "A" position, and the timer selector switch 81 is at "24", the mattress support 15 will operate and stop according to the twenty-four hour timer switches 83 and stop only at the horizontal position. The specific hourly operation depends upon the setting of the twenty-four hour timer switches 83. For instance, if the twenty-four hour timer switches 83 are set for 15 minutes, then one every four unit switches 84 are "on" and rest are "off". At this setting, the mattress support 15 will roll for fifteen minutes and stop for forty-five minutes at its horizontal position. More specifically, ninety-six fifteen-minute time unit switches 84 are disposed along the circular periphery of the timer switch 83. Therefore, the mattress support 15 could be rolled and stopped for any of the specific fifteen minute unit by setting the corresponding one of the fifteen-minute time unit switches 84.

A third operation employs a horizontal stop and automatic any rolling time period—any stop time period operation. In the third operation, the timer selector switch 81 is switched to "120" from "24", the operation timer switch 85 is selected for its operation time period, for instance, 0–120 minutes, and the stop timer switch 87 is selected for its stop time period, for instance, 0–60 minutes. In this setting, the mattress support 15 will be rolling for the predetermined time period of the operation timer switch 85. and will stop at its horizontal position for the predetermined time period of the stop timer switch 87.

A fourth operation employs alternately stopping the automatic twenty-four hour operation cycling operation. Under this operation, motor 59 is driven selectively during the twenty-four hour period, but the mattress support stop position selector switch 79 is switched to "ABC" from "A". This setting controls the mattress support 15 to stop alternately at the horizontal, leftward inclined, and rightward inclined position in turn, because the motor stop position switches, 65A for horizontal position, 65B, for leftward inclined position, and 65C, for rightward inclined position, alternately stop the mattress support 15.

A fifth operation employs alternative stops in conjunction with any rolling time period—any stop time period operation. According to the fifth operation, the selector switch 79 is switched to "ABC" position from the "A" position controlling the mattress support 15 to stop in the three possible. The mattress support 15, however, rolls as described in the third operation.

The inclining device 14 in FIG. 1 has 2 inclining adjustable bolts threaded at the side longitudinal end covers of the bed frame 3 which is inclined by turning the bolts 89. The degree of the inclination shall be determined by the user.

The four springs 92, each freely inserted into a different one of the four spring housings 90, are firmly and perpendicularly attached at the corners of the bed frame 3. When one side of the support 15 starts to come down, two side springs 92 are compressed, and then extended as the one side starts to come up. This action reduces peak energy consumption, thereby minimizing the motor's 59 capacity.

A second embodiment for the adjustable crank arm assembly 43 is shown in both FIG. 8, is different from the crank assembly of FIG. 3, and is infinitely adjustable. The crank arm assembly 43 has a rectangular groove 91 formed radially through the center of the circular crank plate 44. At both ends of the groove 91, two brackets 97 with bolt holes (not shown) and a shaft hole 93 are bolted to the crank plate 44 with bolts 99. A screw shaft 95 attached with a handle 101 passes rotatably through both shaft holes 93. A crank pin block 105 is screwed onto the screw shaft 95 between the bracket 97 and is slidable along the groove 91 when the handle 101 is rotated. Screwed crank pin 103 is perpendicularly attached for engaging the connecting rod assembly 16. Likewise the length of the crank arm is controlled. On the rear face of the crank plate 44 the roller cam 55 is fastened to the plate 44 by the roller cam fastening bolt 57.

Figure 9:
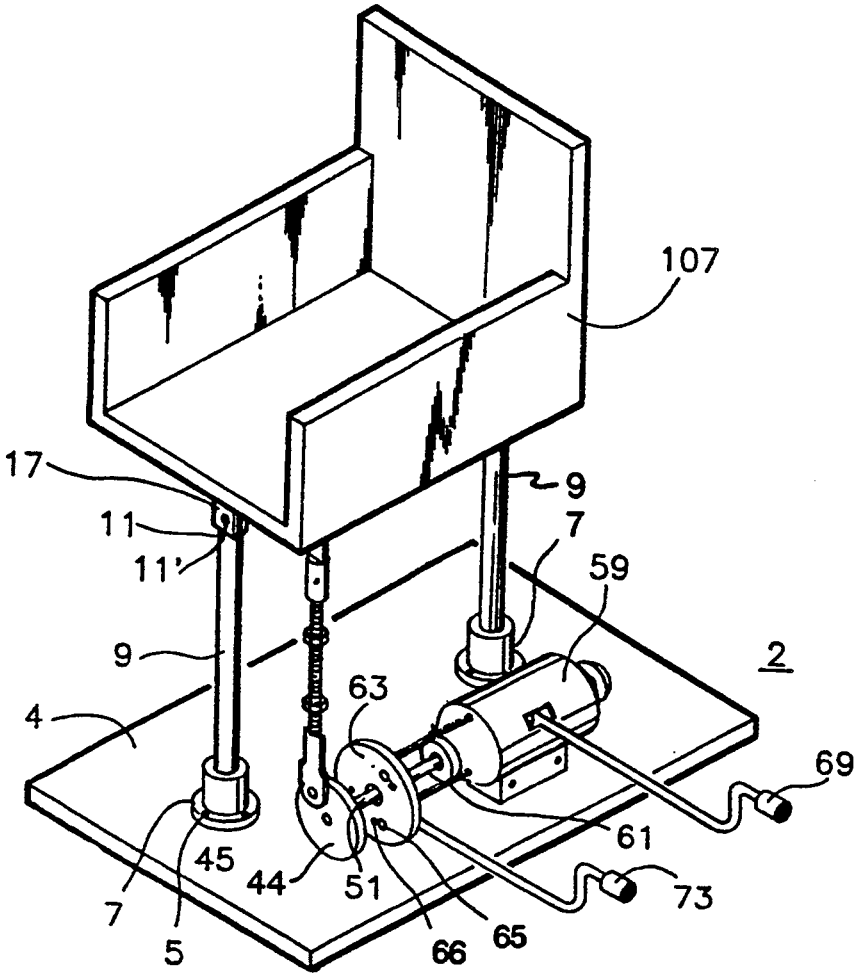
FIG. 9 is a perspective view of a rolling chair embodying the present invention.

The rolling chair 2 shown in the FIG. 9 is constructed similarly to the rolling bed 1 of FIG. 1, except that a chair 107 is substituted for the mattress support 15 and the mattress 10. Here, inclining device 14 and energy saving device 13 are excluded.

Figure 10:
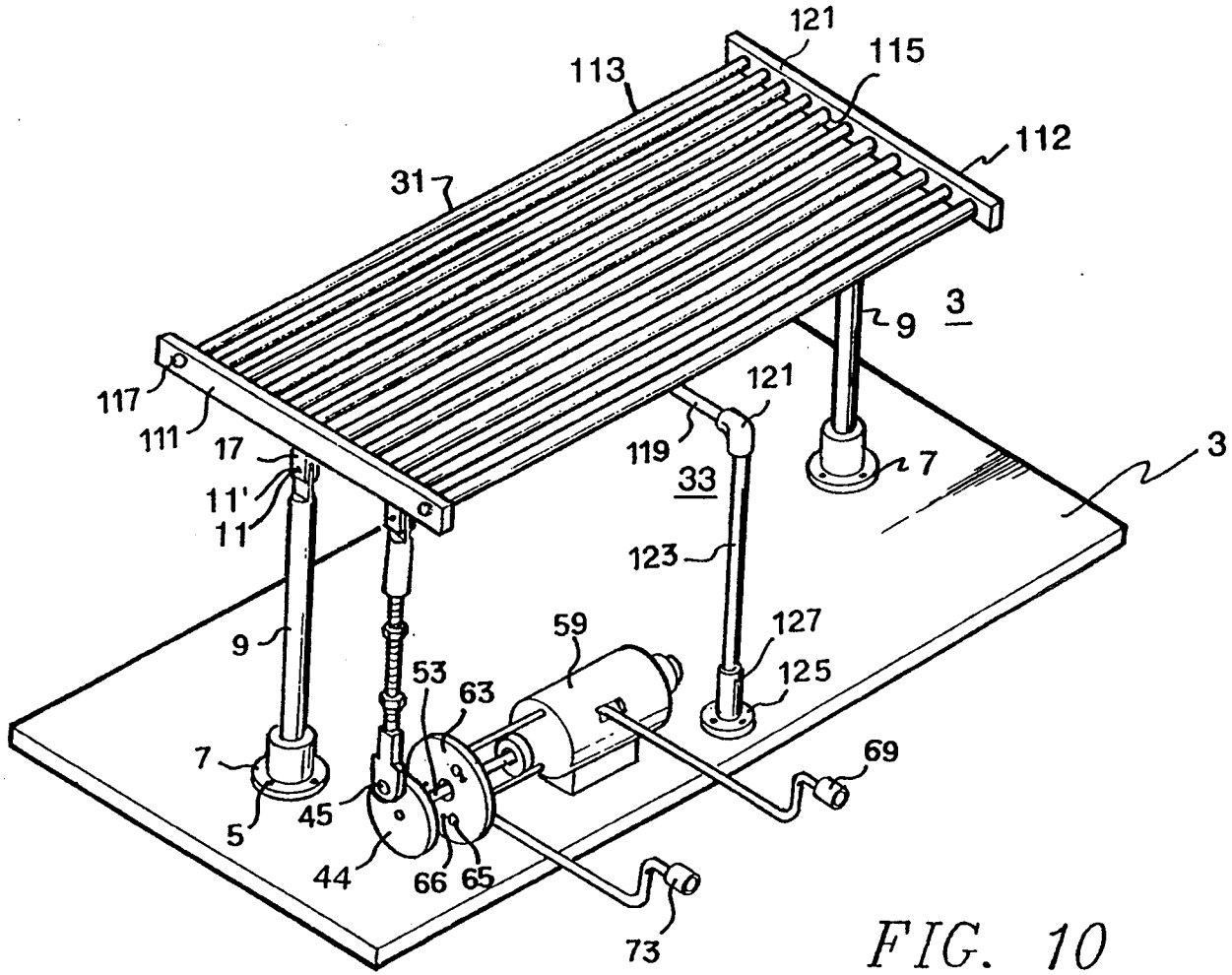
FIG. 10 is a perspective view of a twist rolling bed embodying the present invention.

The twist rolling bed 3 shown in the FIG. 10 is similar to the rolling bed 1 of FIG. 1 except for two major differences. First, the mattress support assebmly 31 has a different structure from the mattress support 15 which it replaces. Second, the twist rolling bed 6 includes saddle assembly 33 to support a latitudinal axis of the mattress support assembly 31.

As shown in the FIG. 10, the mattress support assembly 31 comprises a plurality of mattress support pipes 113 constructed of metal or plastic. The mattress support pipes 113 are pivotally, rotatably, and longitudinally slidably, placed into circular holes 115 drilled along central line of rectangular frame support bars 111 and 112. Each end of the outermost pipes of the plurality of pipes 113 is are inserted slidably into the pivotable shaft bearing 117 and tightly inserted through the bigger outermost circular holes 115 and held in place by nuts (not shown).

The saddle assembly 33 comprises a round saddle support bar 119, elbows 121, posts 123, post strands 125, and bolts and nuts 127. The round saddle support bar 119 supports the middle of each of the mattress support circular pipes 113 but allows them to roll freely. The round saddle support bar 119 connects with the right angle elbows 121 by thread which in turn connect to posts 123 also with threads. The posts 123 are perpendicular to the bed frame 3 and tightly inserted to posts stands 127 which are firmly attached to the frame 3 by bolts and nuts 125. As shown in the FIG. 10, the mattress support assembly 31 freely rides on saddle assembly 33. Therefore, when an end of the frame support bar 111 is pulled down, the opposite end of frame support bar 111 comes up because of the pivoting point of the bolt hole 11. Further, the opposite fram support bar 112 responds oppositely to the frame support bar 111's movement. Consequently, the mattress support assembly 31 undergoes a twisting motion and making the human body twist with it. This twist rolling bed does not require the energy saving device 13 because of the saddle assembly 33.

Figure 11:
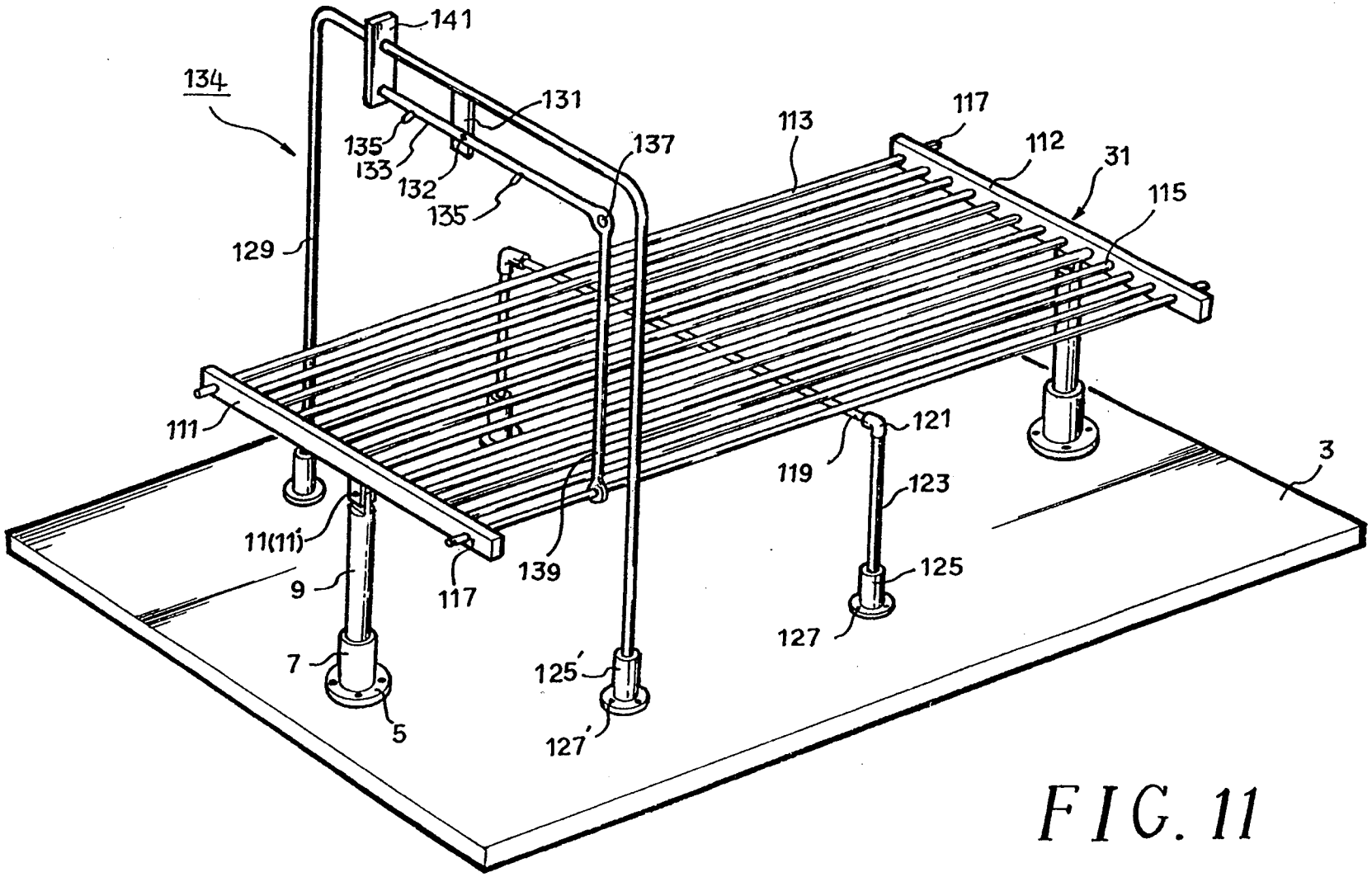
FIG. 11 is a perspective view of a manual twist rolling bed embodying the present invention.

Another embodiment of FIG. 11 is a manaul twist rolling bed obtained by replacing the vibrating system 150 of the twist rolling bed of FIG. 10 by a manual vibrating system 134. As shown in the FIG. 11, two post stands 125' are bolted to the bed frame 3 near the post 9 and between the post 9 and the post 123. A "U" shaped manual lever bridge 129 was inserted into post 125' that has a lever 131 with a hole formed therein. A lever 133 has two lever handlses 135 which are horizontal and perpendicular to it and rotatably pinned by a bracket pin 132. One end of the lever 133 is pivotally connected to a manual connecting rod 139 which is ringed to an outermost support circular pipes 113. The other end of level 133 could be secured to the manual lever bridge 129 by lever holder 141 holes by sliding forward and backward. While sleeping it is secured so that the mattress support assembly 31 may maintain its horizontal position. During exercise, it is released so that a patient can push and pull level 133 with lever handles 135 simultaneously and alternately with both hands making the mattress assembly 31 twist and roll.

The mechanism comprising the post stand 125', manual bridge 129, lever bracket 131, lever pin 132, lever 133, lever handle 135, lever pin 137, manual connecting rod 139, and lever holder 141 is called manual vibrating system 134.

For easier whole body twist exercises, the vibrating system and the manual vibrating system could simultaneously be operated.

For the simplicity of the drawings, the headboard and the footboard found in conventional beds have been eliminated.

Without further analysis, the forgoing will so fully reveal the gist of the present invention that others can, by applying current knowledge, readily adapt it for various applications without omitting features that, from the standpoint of prior art, constitute essential characteristics of the generic and specific aspects of my contribution to the art and, therefore such adaptions should and are intended to be comprehended within the meaning and range of equivalence of the claims.

I claim:

1. A rolling bed for use in home and hospital, especially for health care, comprising:

a bed frame made in a rectangular shape having an inclining device at one lateral side corner of said frame, spring housings perpendicularly attached to said bed frame and coil springs freely supported by said spring housings;

a support assembly having a support surface, two poststands attached at opposite central longitudinal ends of said bed frame, two posts inserted into corresponding ones of said poststands and extending perpendicularly to said bed frame, each of said posts having a distal end, each said distal end being rotatably connected to opposite ends of said support surface along a central longitudinal axis of said support surface;

said support assembly being disposed to support a mattress thereon with said energy saving device positioned underneath a plurality of corners of said support surface to engage corresponding ones of said corners as said support surface;

a vibrating system that reciprocates said support assembly and comprises a connecting rod assembly coupling said vibrating system to said support assembly, a motor crank assembly connected to drive said connecting rod assembly, and an electric control switch board;

said connecting rod assembly having a connecting rod flange connected to one of said corners of said support assembly and two side plates rotatably connecting said connecting rod flange to said support assembly, said side plates being firmly connected to a first rod bearing housing, said first rod bearing housing having a rod bearing perforated by a first rod bearing hole at one end positioned between two side plates, said connecting bolt having a second rod bearing housing perforated by a second rod bearing hole connected to said motor crank assembly;

said motor crank assembly comprising a circular crank plate with said crank arm connected thereto by a roller cam, and a motor shaft hole and crank flange, a motor shaft of a motor being inserted into said shaft hole and attached to said bed frame, said motor crank assembly having a motor power source plug coupled to said switch board, and a motor stop switch plate, said motor stop circular plate having a hole in its center for said motor shaft, said switch plate having a plurality of motor stop position switches, a plurality of stop position cam followers motivated by said roller cam, and a motor stop circular switch signal plug; and said electric control switch board having a power source plug, motor power source socket connectable to said motor power source plug, a switch board signal receiving socket connectable to said switch signal plug, a push-on push-off switch, a support stop position selector switch, a timer selector switch, an operation timer switch, stop timer switch, and a twenty-four hour timer switch comprising a plurality of time unit switches.

2. A rolling bed as defined claim 1, further comprised of:

said support assembly comprising a chair, said bed frame comprising a frame for said chair.

3. A rolling bed as defined in claim 1, wherein said circular crank plate comprises an adjustable crank arm assembly comprising a rectangular groove across a diameter of said crank plate, two brackets having shaft holes positioned at the ends of said groove by bolts, a screw shaft having a handle at its end inserted into said bracket, a crank pin block threadingly engaging said screw shaft, and a crank pin extending perpendicular to said circular crank plate to connect said crank plate to said second rod bearing hole.

4. The bed assembly of claim 2, wherein said circular crank plate comprises an adjustable crank arm assembly.

5. A twist rolling bed, comprising:

a bed frame made in a rectangular shape having an inclining device at a plurality of corners of said bed frame;

a support assembly having a support surface, two poststands, two posts inserted into different corresponding ones of said poststands to extend perpendicularly to said bed frame, distal ends of said posts being rotatably connected to opposite ends of said support surface along a central longitudinal axis of said support assembly;

said support surface comprising upper and lower frame members having widths comparable to a width of a supine human being, a plurality of elongate members each having lengths comparable to a length of the supine human being, both ends of said elongate members being pivotally, rotatably, longitudinally slidably, and perpendicularly inserted partially into circular holes formed along a central straight line extending along the upper and lower rectangular frame support bars, a plurality of bearings tightly fitted into corresponding ones of said circular holes formed at each extremity of said straight line and having both ends of outermost ones among said elongated members being inserted slidably into the bearings;

a saddle assembly having a saddle support bar rotatably supporting a middle of each said elongate member, and means extending perpendicular to said bed frame and firmly attached to said bed frame, for supporting said support bar spaced-apart from said bed frame and beneath said plurality of elongate members to engage said elongate members as said support surface rotates around said distal ends; and a vibrating system reciprocating said support assembly and stopping said support assembly, said vibrating system having a connecting rod assembly, a motor crank assembly, and an electric control switch board;

said connecting rod assembly having a connecting rod flange connected to one of said corners of said support assembly and rotatably connecting two side plates by bolt and nut, said side plates being freely connected to a rod bearing housing by bolt and nut, rod bearing housing having a rod bearing and a rod bearing hole at a first end and a female thread at a second end with a connecting bolt engaging said female thread, said connecting bolt having another rod bearing housing with a rod bearing hole receiving a crank arm pin bolt hole of a circular crank plate of said motor crank assembly;

said motor crank assembly comprising a motor having a motor shaft, said circular crank plate with said crank arm pin bolt holes and roller cam bolted thereto by a fastening bolt and nut extending through said roller cam, and a shaft hole within said crank plate accommodating passage of said motor and a crank flange having a lock bolt thereon, said motor being attached to said bed frame, a motor power source plug attached to a motor step circular switch plate by a motor stop circular switch plate stay, said motor stop circular switch plate having a hole in its center to accommodate the motor shaft, motor stop position switches, stop position cam follower motivated by said roller cam, and motor stop circular switch signal sending plug; and said electric control switch board having a power source plug, a motor power source socket connectable to said motor power source plug, switch board signal receiving socket connectable to said signal sending plug, a push-on push-off switch, a mattress support stop position selector switch, timer selector switch, operation timer switch, stop timer switch, and a twenty-four hours' timer switch comprising a plurality of unit time switches.

6. A twist rolling bed as defined in claim 5, wherein said circular crank plate comprises an adustable crank arm assembly with a rectangular groove formed across a diameter of said crank plate, two brackets having shaft holes in a central part being attached to ends of said groove, a screw shaft having a handle inserted in said brackets, a crank pin block positionable by said screw shaft, and engaging a crank pin extending perpendicularly to said circular crank plate through said rod bearing hole.

7. A twist rolling bed as defined in claim 5, wherein said vibrating system comprises a manual vibrating assembly comprising a post stand, a manual lever bridge, a lever bracket attached to said lever bridge at a location above said support surface, bracket pin, a lever coupled to said lever bracket by said bracket pin, lever handles extending outwardly from said lever, a lever pin, a manual connecting rod joined to said lever by said lever pin and connected to one of said outermost ones of said elongate members at a location between said support bar and one of said frame members, and a lever holder slidingly coupling a second end of said bar to said lever bridge.

8. A twist rolling bed for use in health care, comprising:

a bed frame;

mattress support means having a support surface, said support means disposed over said bed frame, for receiving and supporting a mattress, said mattress support means being longitudinally torsionally flexible, said support surface comprising a pair of spaced-apart terminal portions extending transversely to a longitudinal axis, with said longitudinal axis lying in a first plane, said first plane dividing said support surface into opposite lengths, a transverse axis being spaced-apart from both of said terminal portions and lying in a second plane intersecting said first plane and dividing said support surface into opposite ends, said first plane and said second plane dividing said support surface into quadrants;

a support assembly, fixedly attached to said bed frame, for pivotally supporting said mattress support means, said support assembly engaging said support surface at a pair of pivots coaxially aligned along said longitudinal axis, and maintaining said support surface spaced apart from said bed frame; and driving means, disposed on said bed frame, for vertically displacing a side of said mattress support means and thereby causing oscillation of said support surface, said driving means having a connecting link engaging a first quadrant of said support surface and oscillating said support surface to raise a corner of said first quadrant above said longitudinal axis while depressing below said longitudinal axis a corner of a second quadrant contiguous with and on the same side of said second plane as said first quadrant as said first quadrant.

9. A twist rolling bed as defined in claim 8, wherein said driving means is a manual vibrating system for allowing a user to manually propel said twist rolling bed and thereby cause said torsional twisting of said mattress support means.

10. A twist rolling bed according to claim 9, wherein said driving means comprises:

a frame support extending vertically from said bed frame;

a lever pivotally attached to said frame support and positioned above said mattress to be pivoted by a user reclining on said mattress; and a link connecting said lever to said mattress support means to transmit pivoting of said lever to vertical displacement of said side of said mattress support means.

11. A twist rolling bed according to claim 8, wherein said mattress support means comprises:

a first frame support bar and a second frame support bar each pivatally engaging said support assembly means via corresponding ones of said pair of pivots; and an array of mattress support members, stretching between said first frame support bar and said second frame support bar, for carrying said mattress.

12. A twist rolling bed according to claim 11, further comprising a saddle assembly including a horizontal member supporting said mattress support members substantially at center portions of said mattress support members, and maintaining said center portions spaced-apart from said bed frame, said saddle assembly remaining substantially stationary relative to said bed frame during said oscillation of said support surface.

13. A twist rolling bed according to claim 12, wherein said support assembly means comprises a first post and a second post, each pivotally attached to centers of different ones of said first frame support bar and said second frame support bar and fixedly attached to said bed

14. A twist rolling bed according to claim 8, wherein said driving means comprises:

a motor; and a connecting rod assembly for translating rotational movement of said motor into said oscillation of said support surface.

15. A twist rolling bed according to claim 8, having a plurality of operating modes, said plurality of operating modes comprising:

a first mode for operating said driving means to impart said oscillation to said support surface in response to an on/off switch;

a second mode for operating said driving means to impart said oscillation to said support surface for selected time periods of a plurality of time periods in a day; and a third mode for initiating operation of said driving means to impart said oscillation to said support surface in response to a user selected on time and then terminating said operation in response to a user selected off time.

16. A twist rolling bed according to claim 8, further comprising a transverse member mounted upon said bed frame coaxially with said transverse axis, said transverse member lying within said second plane and engaging said support means, said transverse member remaining stationary relative to said bed frame while said driving means oscillates said first quadrant.

17. The bed of claim 16, further comprised of said support means further comprising:

a plurality of oppositely disposed, spaced-apart first elongate elements terminating said opposite ends, each of said first elongate elements being perforated by a plurality of openings; and a plurality of second elongate elements lying between said pair of sides and forming an array extending between said first elongate elements, with end portions of said second elongate elements being received within said openings to accommodate rotation of a first plurality of said second elongate elements relative to said first elongate elements and to accommodate sliding along longitudinal axes of a second plurality of corresponding said second elongate elements relative to said first elongate elements.

18. A rolling bed for use in health care, comprising:

a bed frame;

mattress support means, disposed over said bed frame, for receiving and supporting a mattress, said mattress support means comprising a support surface having a pair of spaced-apart terminal portions extending transversely to a longitudinal axis, with said longitudinal axis lying in a first plane, said first plane dividing said support surface into opposite lengths, a transverse axis being spaced-apart from both of said terminal portions and lying in a second plane intersecting said first plane and dividing said support surface into opposite ends, said first plane and said second plane dividing said support surface into quadrants;

support assembly means, fixedly attached to said bed frame, for pivotally supporting said mattress support means to enable said support surface to pivot around said longitudinal axis, said support assembly means comprising a first post and a second post, said first post and said second post each fixedly attached to said bed frame and each pivotally engaging said mattress support means at a pair of pivots coaxially aligned along said longitudinal axis, and maintaining said support surface spaced part from said bed frame; and driving means, disposed on said bed frame, for pivotally repeatedly displacing said mattress support means on said longitudinal axis, said driving means having a connecting link engaging a first quadrant of said support surface and oscillating said support surface to raise a corner of said first quadrant above said longitudinal axis while depressing below said longitudinal axis a corner of a second quadrant contiguous with and on the same side of said second plane as said first quadrant.

19. A rolling bed according to claim 18, further comprising:

motor position sensing means for sensing a rotational position of said driving means and generating position signals indicative of said rotational position; and means for responding to said position signals by controlling stop positions of said mattress support means by stopping oscillation of said support surface by said driving means.

20. A rolling bed according to claim 19, further comprised of said controlling means operating said driving means for selected time periods of a plurality of time periods in a day and alternately stopping said driving means at different ones of a plurality of positions at terminations of each of said selected time periods.

21. A rolling bed according to claim 18, further comprised of means for controlling times and duration of oscillation of said support surface by said driving means.

22. A rolling bed according to claim 18, wherein said driving means comprises:

a motor; and a connecting rod assembly for translating rotational movement of said motor into pivotal displacement of said mattress support means.

23. A rolling bed according to claim 22, wherein said driving means further comprises:

a crank plate fixedly attached to a drive shaft of said motor, said connecting rod being connected to said crank plate.

24. A rolling bed according to claim 23, wherein a radial point of connection between said crank plate and said connecting rod is variably adjustable across a continuum defined by a width of said crank plate.

25. A rolling bed according to claim 18, further comprising inclining means for raising a first end of said bed frame relative to a second end of said bed frame, wherein said first end longitudinally opposes said second end.

26. A rolling bed according to claim 18, having a plurality of operating modes, said plurality of operating modes comprising:

a first mode for operating said driving means to impart said oscillation to said support surface in response to an on/off switch;

a second mode for operating said driving means to impart said oscillation to said support surface for selected time periods of a plurality of time periods in a day; and a third mode for initiating operation of said driving means to impart said oscillation to said support surface in response to a user selected on time and then terminating said operation in response to a user selected off time.

27. A rolling bed as defined claim 18, wherein said mattress support means comprises a chair frame for receiving a user positioned in a sitting position.

28. A rolling bed according to claim 18, further comprising a transverse member mounted upon said bed frame coaxially with said transverse axis, said transverse member lying within said second plane and engaging said support means, said transverse member remaining stationary relative to said bed frame while said driving means oscillates said first quadrant.

29. A rolling bed for use in health care, comprising:

a bed frame;

mattress support means, disposed over said bed frame, for receiving and supporting a mattress, said support means comprising a support surface, a pair of spaced-apart terminal portions extending transversely to a longitudinal axis, with said longitudinal axis lying in a first plane, said first plane dividing said support surface into opposite lengths, a transverse axis being spaced-apart from both of said terminal portions and lying in a second plane intersecting said first plane and dividing said support surface into opposite ends, said first plane and said second plane dividing said support surface into quadrants;

support assembly means, fixedly attached to said bed frame, for pivotally supporting said mattress support means to enable said mattress support means to pivot about a longitudinal axis, said support assembly means comprising a first post and a second post, said first post and said second post each fixedly attached to said bed frame and each pivotally engaging said mattress support means at a pair of pivots coaxially aligned along said longitudinal axis, and maintaining said support surface spaced apart from said bed frame;

driving means, disposed on said bed frame, for repeatedly pivotally displacing said mattress support means on said longitudinal axis, said driving means having a connecting link engaging and oscillating said support surface to raise a first end of an adjacent one of said terminal portions above said longitudinal axis while depressing below said longitudinal axis a second end of said adjacent one of said terminal portions; and energy saving means for absorbing a rotational momentum of said mattress support means at least during extreme limits of the pivotal displacement of said mattress support means, said energy saving means comprising at least one resilient member, fixedly attached to said bed frame, for engaging said mattress support means at least during said extreme limits of said pivotal displacement.

30. The bed defined by claim 29, further comprised of said mattress support means comprising:

a plurality of oppositely disposed, spaced-apart first elongate members;

a plurality of second elongate members forming an array extending between and engaging said first elongate members.

31. A rolling bed according to claim 29, further comprising a transverse member mounted upon said bed frame coaxially with said transverse axis, said transverse member lying within said second plane and engaging said longitudinal members, said transverse member remaining stationary relative to said bed frame while said driving means pivotally displaces said mattress support means.

32. A bed assembly, comprising:

a frame;

support means defining a pair of opposite, spaced-apart ends and a pair of opposite, spaced-apart sides extending between said pair of ends, for supporting a human body;

means for pivotally connecting opposite ends of said support means to said frame;

means for imparting movement to said support means by oscillating said support means about said pivoting means; and limiting means extending from said frame and toward said support means, for maintaining a spaced-apart separation between said support means and said frame and limiting movement of said support means, said limiting means remaining stationary relative to said frame during oscillation of said support means by said movement imparting means.

33. The bed assembly of claim 32, further comprised of said support means further comprising:

a plurality of oppositely disposed, spaced-apart first elongate members forming said pair of ends, each of said ends being perforated by a plurality of openings; and a plurality of second elongate members lying between said pair of sides and forming an array extending between said first elongate members, with end portions of said second elongate members being rotationally received within said openings.

34. The bed assembly of claim 32, further comprised of said oscillating means comprising:

a source of rotational energy mounted upon said frame;

an rotatable assembly rotatably driven by said motive source; and a lever having a first end providing an eccentric connection to said rotatable assembly and a second end pivotally coupled to said support means.

35. The bed assembly of claim 34, further comprised of:

said rotatable assembly being centrally mounted upon said source of rotational energy; and said rotatable assembly comprising means for incrementally varying eccentricity of said connection.

36. The bed assembly of claim 34, further comprised of:

said rotatable assembly being centrally mounted upon said source of rotational energy; and said rotatable assembly comprising means for continously varying eccentricity of said connection.

37. The bed assembly of claim 34, further comprised of said support means further comprising:

a plurality of oppositely disposed, spaced-apart first elongate members forming said pair of ends, each of said ends of said pair of ends being perforated by a plurality of openings; and a plurality of second elongate members lying between said pair of sides and forming an array extending between said first elongate members, with end portions of said second elongate members being received within said openings to accommodate rotation of a plurality of said second elongate members relative to said first elongate members and to accommodate longitudinal sliding of a multiplicity of said second elongate members relative to said first elongate members.

38. The bed of claim 32, further comprised of said limiting means comprising:

a first member connected to said frame; and a second member connected to said first member, spaced-apart from said opposite ends, spaced-apart from said oscillating means, and extending across and engaging said means to provide a fulcrum for accommodating twisting of said support means as said imparting means urges said opposite ends of said support means to rotate relative to said connecting means.

39. The bed of claim 38, further comprised of said support means comprising:

a plurality of oppositely disposed, spaced-apart first elongate members forming said pair of ends, each end of said first elongate members being perforated by a plurality of openings; and a plurality of second elongate members lying between said pair of sides and forming an array extending between said first elongate members, with end portions of said second elongate members being received within said openings to accommodate rotation of a first plurality of said second elongate members relative to said first elongate members and to accommodate sliding of a second plurality of said second elongate members relative to said first elongate members.

40. The bed assembly of claim 32, further comprised of:

a source of rotational energy mounted upon said frame;

a lever for providing a first end with an eccentrically adjustable connection to said source and a second end pivotally coupled to said supporting means; and switching means connected to said source, for responding to said movement by controlling said source in dependence upon movement of said supporting means by said lever toward a righthand inclined orientation, toward a lefthand inclined orientation, and toward a horizontal orientation.

41. The bed of claim 32, further comprised of said limiting means comprising:

a pair of first elongate members each having first ends attached to said frame; and a second elongate member connected to each of second ends of said pair of first elongate members, spaced-apart from said opposite ends, spaced-apart from said oscillating means, and extending approximately parallel to said opposite ends and across said support means to engage said support means to provide a fulcrum for accommodating twisting of said support means as said imparting means urges said opposite ends of said support means to rotate relative to said connecting means.

* * * * *